United States Patent [19]

Williams

[11] 4,171,169

[45] Oct. 16, 1979

[54] HAND HELD WASHER

[76] Inventor: Stanley B. Williams, 2088 E. Empire Lot 151, Benton Harbor, Mich. 49022

[21] Appl. No.: 866,700

[22] Filed: Jan. 3, 1978

[51] Int. Cl.[2] ..... A46B 11/02; B05B 7/30

[52] U.S. Cl. ..... 401/41; 137/604; 137/607; 239/315; 239/586; 401/43; 401/279; 401/289

[58] Field of Search ..... 401/40, 42, 43, 279, 401/204, 289, 41, 278, 270; 239/310, 375, 315, 316, 317, 586; 137/603, 605, 604, 625.4, 607

[56] References Cited

U.S. PATENT DOCUMENTS

| | | | |
|---|---|---|---|
| 2,514,225 | 7/1950 | Dabrohua | 401/43 X |
| 2,540,064 | 1/1951 | Weber | 401/40 X |
| 2,545,110 | 3/1951 | Schaar et al. | 401/43 |
| 2,797,132 | 6/1957 | Alpert | 239/315 X |
| 2,800,798 | 7/1957 | Korsmo | 137/625.4 X |
| 2,876,040 | 3/1959 | DeSimone et al. | 137/605 X |
| 2,975,804 | 3/1961 | Dunn et al. | 239/315 X |

FOREIGN PATENT DOCUMENTS

| | | | |
|---|---|---|---|
| 1208132 | 12/1965 | Fed. Rep. of Germany | 137/604 |
| 506349 | 12/1954 | Italy | 401/43 |
| 74151 | 3/1947 | Norway | 401/279 |

*Primary Examiner*—Edgar S. Burr
*Assistant Examiner*—Steven A. Bratlie
*Attorney, Agent, or Firm*—Gary, Juettner & Pyle

[57] ABSTRACT

A portable washer of lightweight and economical construction is characterized by a body portion having a handle for being held by a user thereof. The body is connectable with a supply of water, and a flexible conduit at an end of the body supports a brush for scrubbing articles such as dishes and the like, and enables the brush to be variously positioned to contact all surfaces of an article being cleaned, irrespective of the configuration of the article. A compartment within the body stores a supply of soap, and a valve on the body is operable by a user of the washer to control both a flow of water through the body and from the brush and introduction of soap into the water, whereby either a soapy washing solution or clear rinse water may be applied to the article being cleansed.

6 Claims, 4 Drawing Figures

32
28
26
62
30
22
20
24
36
34
38
2.
2.

54
56
38

4.
24
22
62
82
66
70
64
52
58
74
68
44
42
60
78
76
72
36
48
80
46
32
40
50
4.
56
54
34
38

24
66
82
40
44
68
78
74
42
80
46

HAND HELD WASHER

BACKGROUND OF THE INVENTION

The present invention relates to a hand held portable washer for dishes and the like.

For individuals who cannot enjoy the benefits of an automatic dishwasher, perhaps because they are constantly on the move or do not have sufficient space within their living quarters to accommodate such a dishwasher, washing dishes with a dish rag or sponge is not only tedious and time consuming, but is also quite hard on and irritating to the skin on their hands.

It would therefore be extremely desirable to provide a washer for dishes which is portable, lightweight amd easily hand held, which requires little space for storage and use in situations where an automatic dishwasher cannot be accommodated, and which enables rapid an thorough washing and rinsing of dishes without the need for a user to resort to a separate dish rag or sponge, or to constantly immerse his or her hands into washing and rinse solutions.

OBJECTS OF THE INVENTION

An object of the present invention is to provide a hand held washer which is particularly suited for the cleansing of dishes, kitchen utensils and the like.

Another object of the invention is to provide such a washer which is of lightweight, efficient and economical construction, and which is readily portable and requires little space for storage.

A further object of the invention is to provide such a washer which is connectable with a supply of water for dispensing the same, and which includes a compartment for storage of soap to be introduced into the water in the washing of articles.

Yet another object of the invention is to provide such a washer which includes a valve for selectively controlling the dispensing of water and soap from the washer, whereby articles may readily and conveniently be both washed and rinsed.

SUMMARY OF THE INVENTION

In accordance with the present invention, a washer includes a body portion having a handle for and gripped by a user thereof, and a compartment for storing a supply of a washing solution such as soap. The body is connectable with and supply of water, a flexible conduit connects a brush with the body, and valve means are provided for selectively introducing soap into the water passing through the brush, whereby either a washing solution or a rinse bath may be dispensed through the brush onto the article.

In accordance with a preferred embodiment of the invention, a passage through the body accommodates movement of water from the supply of water to the brush, and the valve controls both an introduction of soap into the passage and a flow of water through the passage. The valve is positioned in the body forwardly of the handle for convenient manipulation by a user of the washer, and is manually manipulable to accommodate washing or rinsing the articles.

In one of its positions the valve establishes an opening between the soap compartment and the passage to introduce soap into the water to provide a soapy washing solution at the brush, while simultaneously reducing the flow of water through the passage so as not to excessively dilute the soap. Upon the article being soaped, the valve is then movable to a second position to both close the opening between the soap compartment and the water passage and to terminate the flow of water through the passage, whereby the previously soaped article may be scrubbed with the brush without waste of soap or water. After the article is scrubbed, the valve is then movable to a third position to close the opening between the compartment and the passage and open the passage for a full flow of water therethrough, whereby the article may readily be rinsed free of washing solution with a clear, soap free flow of water from the brush. To accommodate washing and rinsing of all surfaces of the articles, the flexible conduit enables the brush to be easily extended into even hard to reach positions and to be oriented in a manner to accommodate thorough scrubbing of all surfaces of the articles.

The foregoing and other objects, advantages and features of the invention will become apparent from a consideration of the following detailed description, when taken in conjunction with the accompanying drawings.

IN THE DRAWINGS

Figure 3:
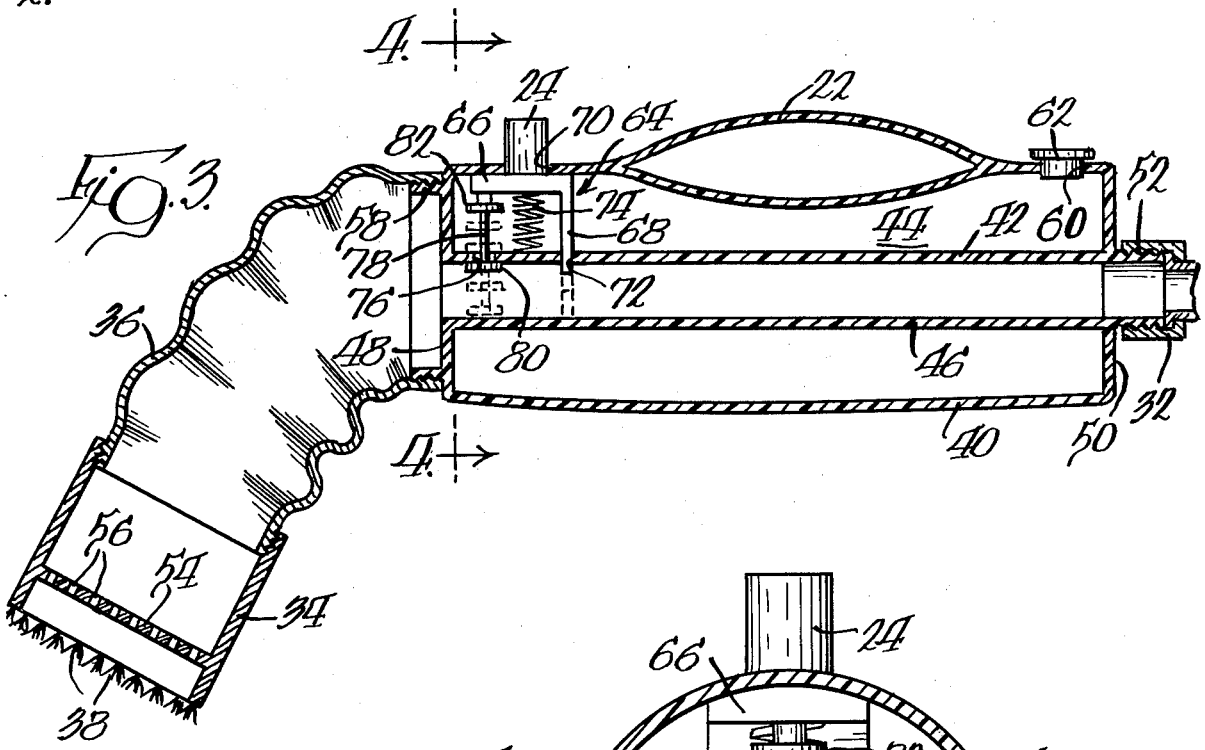
Figure 4:
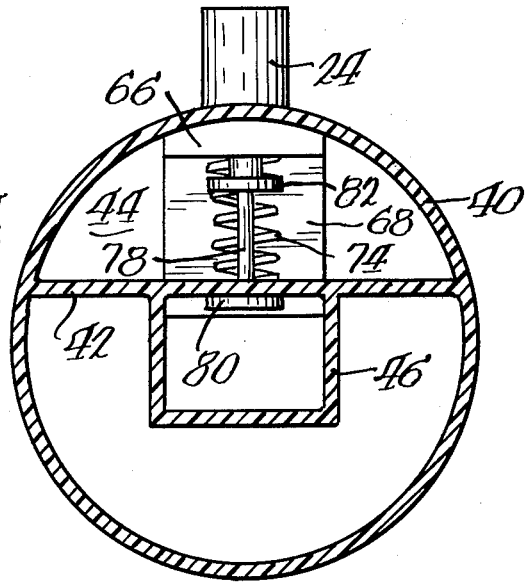

FIG. 3 is a cross-sectional side elevation view of the washer, and particularly illustrates a valve for controlling both the application of soap from a soap compartment into a water passage through the washer, and a flow of water through the passage, and FIG. 4 is a cross-sectional view taken substantially along the lines 4—4 of FIG. 3, and shows additional structural features of the soap compartment, water passage and valve.

DETAILED DESCRIPTION

Referring to the drawings, there is shown a portable or hand held washer which is particularly adapted for the washing of dishes. The washer is of lightweight and compact construction, whereby the same is easily handled in its use and requires little space for convenient storage. Means are provided for accommodating a supply of soap within the washer, the washer is connectable with a supply of water, and valve means enable selective dispensing of soap and water from a brush thereof. The brush has bristles for scrubbing dishes or other articles to be cleaned, and is supported by an elongate, flexible extension, whereby the brush may readily be oriented to accommodate scrubbing and cleansing of articles of substantially any geometric configuration.

To facilitate washing and rinsing of articles, the valve means is manipulable by a user of the washer to selectively control the dispensing of soap and water through the brush. In one of its positions the valve causes a reduced flow of water from the brush while simultaneously introducing soap into the water, whereby an article to be cleansed may be soaped or lathered. After a sufficient quantity of soapy water is introduced onto the article, the valve is then movable to another position to interrupt the supply of soap to and the flow of water through the brush, whereby the brush may then, with the aid of the soapy water previously applied onto the article, be moved about the article to scrub the same. After the article is scrubbed, the valve may then be moved to a third position whereat a full flow of water is accommodated through the brush without the introduction of soap therein, so that the article may be rinsed clean. The washer thus provides a convenient means, easily manipulable in one hand by a user, for washing and rinsing articles such as dishes without the need for separate wash and rinse solutions, sponges, dish rags and the like.

Figure 1:
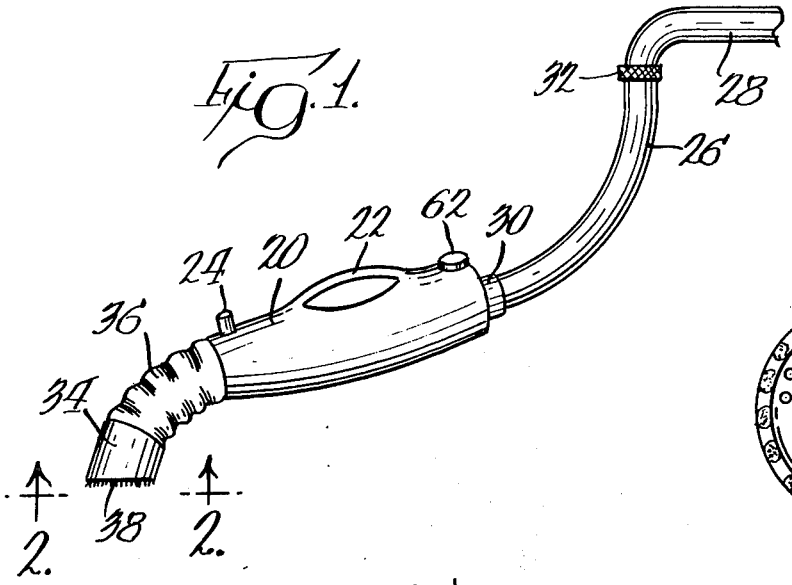
FIG. 1 is a perspective view of a hand held washer in accordance with a preferred embodiment of the invention, showing the washer connected with a supply of water.

More particularly, and referring to FIG. 1, the washer includes a central body portion or housing 20 which advantageously is integrally and economically formed of a lightweight yet strong material, such as plastic. The body includes a handle 22 enabling the same to be held by a user, and a stem or plunger 24 of a valve means extends through the body forwardly of the handle for conveniently being manipulated by the user with the same hand with which he grips the handle. Means are provided, such as a flexible hose 26, for connecting the washer with a supply of water, for example the outlet from a faucet 28, the hose being connected with the body and the faucet by means of a pair of couplings 30 and 32, at least the coupling 32 preferably being of the quick connect type to enable the washer to quickly and conveniently be connected and disconnected with and from the faucet. A brush 34, which also may economically and integrally be formed of plastic, is connected with a forward end of the body 20 by an elongate flexible conduit or extension 36. The flexible extension conducts a flow of water from the body to the brush and permits positioning of the brush in various orientations with respect to the body, whereby the brush may readily be positioned to wash all surfaces of an article of substantially any geometric configuration, and bristles 38 are provided about a lower end of the brush for scrubbing of the article.

Figure 2:
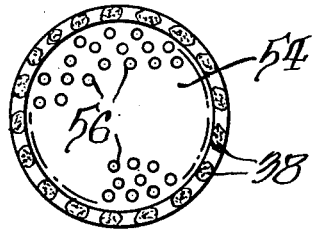
FIG. 2 is a plan view taken substantially along the lines 2—2 of FIG. 1, illustrating the arrangement of bristles and water outlet holes in a brush of the washer.

Referring to FIGS. 2–4, the body 20 comprises an outer wall 40, and the handle 22 is integrally formed with the upper end of the wall. The wall or barrier 42 extends across the interior of the outer wall and forms therewith a soap storage chamber or compartment 44, and a rectangular water passage 46, one side of which is provided by the wall 42, extends along the length of the body. The outer wall includes forward and rearward end walls 48 and 50, respectively, with the forward end of the water passage 46 terminating at inner ends of the end wall 48, and with a rearward end of the water passage extending through the end wall 50 for being connected with the hose 26. To this end, the water passage 46 is formed at its rearward end into cylindrical shape and provided with threads 52 beyond the end wall 50, whereby the water passage is connectable with the hose 26 by means of the coupling 32 in a manner as is conventional.

The brush 34 includes an outer cylindrical wall portion having a transverse wall 54 therein. A plurality of apertures or openings 56 are formed through the wall 54 to accommodate a flow of water therethrough, and the bristles 38 are imbedded in and around the outermost end of the brush in a circular array. The flexible extension 36 connecting the brush with the forward end of the body 20 may be of metal or other suitable material, and includes outer threads at one of its ends for being engaged with inner threads on the brush, and inner threads at its opposite end for being engaged with outer threads formed on an annular extension 58 of the forward end wall 48. For the structure shown and described, water from the faucet 28 passes through the hose 26, the water passage 46 in the body 20, the flexible extension 36 and the openings 56 in the brush 34 for passage from the brush.

With a supply of liquid soap introduced into the storage compartment 44 through a passage 60 formed in the outer wall 40, the passage normally being closed by a removable plug 62, valve means 64 are provided for controlling both a flow of soap from the storage compartment and a flow of water through the water passage 46 to the brush 34. The valve means includes a generally L-shaped member having an upper section 66 and a rearward downwardly depending rectangular section 68. The upper section is connected with the lower end of the valve plunger 24, the plunger for this purpose being extended through and slidingly sealed within a passage 70 in the outer wall, and the downwardly depending section is extended through and slidingly sealed within a rectangular passage 72 formed in the barrier wall 42 for movement into and out of the water passage. To this end, the slot 72 and wall 68 are of the same width as the interior of the water passage 46, whereby downward movement of the wall 68 effectively decreases the fluid flow area through the water passage 46.

A spring 74 is maintained under compression between the section 66 and the wall 42, and normally urges the L-shaped valve member, and therefore the plunger 24, to an uppermost position whereat the section 66 engages the wall 40. To selectively connect the soap in the compartment 44 with the water passage 46, whereby a soapy washing solution may be provided at the brush, an opening 76 is formed through the wall 42 between the soap compartment and the water passage and may selectively be opened or closed by the valve means. This is accomplished by providing at a forward end of the upper section 66 a stem 78 which extends downwardly through the opening, and which is of a diameter smaller than that of the opening. A seal 80 is fastened to the lowermost end of the stem, and when the valve is in its uppermost position the seal is engaged with the lower surface of the wall 42 about the opening to close the opening. A second seal 82 is provided on the stem toward an upper end thereof, and when the valve is in its lowermost position the seal engages the upper surface of the wall about the opening position close the same. With the valve means at a positon intermediate its uppermost and lowermost positions, both seals are out of engagement with the wall, and a passage is established for a flow of soap from the compartment and into the water passage as a result of a venturi effect as water passes over the opening.

The arrangement of the valve means allows a user of the washer to selectively and conveniently wash, scrub or rinse articles. In particular, with the plunger 24 of the valve released by the user and in its uppermost position, the seal 80 closes the opening between the soap compartment and the water passage and the lower end of the downwardly depending section 68 is elevated in the water passage to open the passage for a full flow of water therethrough. Under this condition clean, unsoapy water is provided through the brush 34 to rinse, flush, or otherwise wet the article to be washed.

To apply a soapy solution through the brush 34, the plunger 24 is depressed sufficiently to move the seal 80 out of engagement with the wall 42, yet not so far as to bring the seal 82 into engagement with the wall. This establishes a passage between the soap compartment and the water passage through the opening 76 and about the valve stem 78, whereby soap is introduced into water flowing through the water passage to provide a soapy solution to the brush. It should be noted that this also moves the lowermost end of the section 68 partially into the water passage to reduce the flow of water therethrough, which advantageously prevents excessive dilution of the soap and provides a means for controlling the flow rate of soapy water through the brush, the particular rate of flow being controllable in accordance with the amount of downward movement of the plunger. Thus, a user may conveniently apply a soapy washing solution onto an article merely by depressing the plunger, with the rate of flow of the solution being controlled by the extent to which the plunger is depressed.

After a sufficient quantity of a soapy solution has been applied onto the article, the flow of the solution from the brush may be terminated while the article is scrubbed with the brush, thereby minimizing waste of soap and water. This is accomplished by depressing the plunger 24 to its lowermost position to bring the seal 82 into engagement with the wall 42 about the opening 76, whereby the soap compartment is effectively sealed from the water passage, and to move the lowermost end of the section 68 fully into and through the water passage to seal the passage against a flow of water therethrough. The article may then be scrubbed with the bristles 38 without any additional discharge of a soapy washing solution from the brush or, if desired, the plunger may be manipulated during scrubbing to provide a controlled flow of soapy water from the brush, perhaps by intermittently interrupting and establishing the flow, whereby a proper supply of washing solution may be maintained on the article for effective cleansing of the same.

After scrubbing is completed, the article may rapidly and thoroughly be rinsed clear of soap merely by releasing the plunger, thereby enabling the valve means to return to its uppermost position. When this occurs, the seal 80 again closes the opening between the soap compartment and the water passage, thereby interrupting the introduction of soap therein, and the lowermost end of the section 68 is moved upward within the passage to permit a full flow of water therethrough, whereby a relatively high volume flow of clear, unsoapy water is provided from the brush for rinsing the soap from the article.

The invention thus provides a lightweight, economical compact and portable washer, particularly adapted for the cleansing of dishes and the like. The washer is adapted to easily be held in a hand of a user, and enables the user to conveniently and selectively provide either a soapy washing solution, no solution whatsoever, or a clear rinse solution from the brush, whereby articles may be soaked, scrubbed or rinsed.

While one embodiment of the invention has been described in detail, it is understood that various modifications and other embodiments thereof may be devised by one skilled in the art without departing from the spirit and scope of the invention, as defined by the appended claims.

What is claimed is:

1. A hand held washer comprising a housing having a passage therethrough and a compartment therein for holding a supply of soap; a handle on said housing for being gripped by a user of said washer; means for connecting one end of said passage with a supply of water under pressure; a brush; a relatively flexible conduit connected between an opposite end of said passage and said brush and flexible to mount said brush in various positions with respect to said housing, and manually manipulatable valve means for selectively blocking and unblocking an opening between said compartment and said passage, said valve means being mounted in said housing and including a manually depressible plunger extending outward of said housing forward of said handle and toward said brush, a first valve portion connected to said plunger for movement therewith and extending through said opening between said compartment and said passage, said first valve portion blocking said opening when said plunger is not depressed, unblocking said opening when said plunger is partially depressed, and closing said opening when said plunger is fully depressed, and a second valve portion connected with said plunger for movement therewith and extending into said passage on the side of said opening toward said one end of said passage, said second valve portion unblocking said passage when said plunger is not depressed and moving to a position fully blocking said passage when said plunger is fully depressed, so that when said plunger is not depressed said opening is blocked and said passage is unblocked for a flow of clear water to said brush, when said plunger is partially depressed said opening is unblocked and said passage is partially blocked for a restricted and reduced flow of soapy water to said brush, and when said plunger is fully depressed both said opening and said passage are blocked so that there is no flow of soap or water to said brush, whereby said valve means is conveniently and selectively operable to control the flow of soap and water to said brush for soaping, scrubbing or rinsing an article to be cleaned.

2. A hand held washer as set forth in claim 1, said brush having a cylindrical body portion connected at one end thereof with said conduit, and apertured transverse wall within said body portion for passing through said apertures soapy or clear water, and bristles extending outwardly from an opposite end of said cylindrical body portion.

3. A hand held washer as set forth in claim 1, said handle being formed integrally with said housing and said handle and housing being economically formed of plastic.

4. A hand held washer as set forth in claim 1, said housing being elongate and including a wall therein extending along the length thereof and joined therewith to form said compartment.

5. A hand held washer as set forth in claim 4, said passage being substantially rectangular along at least a portion of its length and being joined with said wall, said wall forming one side of said passage whereat said passage is rectangular.

6. A hand held washer as set forth in claim 1, said conduit being threadably and detachably connected with said brush and said housing in communication with said passage.

* * * * *